United States Patent [19]

Tanaka et al.

[11] Patent Number: 4,465,753

[45] Date of Patent: Aug. 14, 1984

[54] INDOLINE ELECTROPHOTOCONDUCTOR

[75] Inventors: Hisami Tanaka, Tokyo; Osamu Takenouchi, Kitamoto; Tatsuo Kawara, Tokyo, all of Japan

[73] Assignee: Dainippon Ink and Chemicals Inc., Tokyo, Japan

[21] Appl. No.: 507,914

[22] Filed: Jun. 27, 1983

[30] Foreign Application Priority Data

Jul. 8, 1982 [JP] Japan ..... 57-117849

[51] Int. Cl.[3] ..... G03G 5/06

[52] U.S. Cl. ..... 430/79; 430/76; 430/78; 430/58; 548/483

[58] Field of Search ..... 430/58, 76, 78, 79; 542/422

[56] References Cited

U.S. PATENT DOCUMENTS

| | | | |
|---|---|---|---|
| 3,707,369 | 12/1972 | Ono et al. | 430/78 |
| 3,730,711 | 5/1973 | Ono et al. | 430/78 |
| 3,765,884 | 10/1973 | Shea | 430/78 |
| 3,784,376 | 1/1974 | Fox | 430/78 |
| 3,823,136 | 7/1974 | Wu et al. | 542/422 X |

FOREIGN PATENT DOCUMENTS

| | | | |
|---|---|---|---|
| 758446 | 11/1970 | Belgium | 430/76 |
| 2349947 | 4/1974 | Fed. Rep. of Germany | 430/78 |

*Primary Examiner*—Roland E. Martin, Jr.

*Attorney, Agent, or Firm*—Sherman & Shalloway

[57] ABSTRACT

An electrophotoconductor of high sensitivity and durability comprising a photosensitive layer containing an indoline compound of the general formula wherein A represents an aromatic hydrocarbon or aromatic heterocyclic group which may have a substituent, and $R_1$ and $R_2$, independently from each other, represent a hydrogen or halogen atom, or an alkyl, aralkyl or aryl group.

16 Claims, 3 Drawing Figures

INDOLINE ELECTROPHOTOCONDUCTOR

This invention relates to a photoconductor for electrophotography. More specifically, it relates to an electrophotoconductor composed of an electrically conductive support and formed thereon a photosensitive layer containing an indoline compound as a photoconductive material.

Heretofore, inorganic photoconductor materials such as selenium, cadmium sulfide and zinc oxide have been widely used to produce photosensitive layers of electrophotoconductors. Much work has been done in recent years on organic photoconductive materials, and some have already gained practical acceptance as electrophotoconductors. The organic photoconductive materials have the advantage of being lighter in weight and easier to form into films and permitting easier production of photosensitive materials than the inorganic ones.

Various photoconductive polymers typified by polyvinyl carbazole have been proposed as the organic photoconductive materials. When used singly, these polymers have poor film-formability, flexibility and adhesion. Addition of a plasticizer, a binder, etc. in an attempt to remove these defect tends to entail other problems such as reduced sensitivity and increased residual potentials. It has been extremely difficult therefore to use these organic photoconductive materials in practical applications.

On the other hand, photoconductors having excellent mechanical properties can be easily obtained by using organic low-molecular-weight photoconductive compounds and selecting polymers having excellent film-formability, flexibility and adhesion as binders for such photoconductive compounds. It has been difficult however to find out compounds which are suitable for the production of photoconductors having high durability and high sensitivity.

The present inventors made extensive investigations in order to produce electrophotoconductors having high sensitivity and high durability by using organic low-molecular-weight compounds as photoconductive substances. These investigations have led to the discovery that specified indoline compounds are suitable for achieving this purpose.

According to this invention, there is provided an electrophotoconductor composed of an electrically conductive support and formed thereon a photosensitive layer containing an indoline compound represented by the following general formula (I)

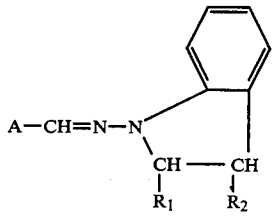

wherein A represents an aromatic hydrocarbon or aromatic heterocyclic group which may have a substituent, and $R_1$ and $R_2$, independently from each other, represents a hydrogen or halogen atom, or an alkyl, aralkyl or aryl group which may have a substituent, as a photoconductive material.

In general formula (I), A is more specifically an aromatic hydrocarbon group derived from benzene, naphthalene, anthracene, pyrene, acenaphthene, fluorenone, etc., or an aromatic heterocyclic group derived from pyridine, pyrrole, pyrazole, dibenzofuran, carbazole, etc. These aromatic hydrocarbon and aromatic heterocyclic groups may have a substituent. Examples of the substituent include alkyl groups such as a methyl or ethyl group, halogen atoms such as a chlorine or bromine atom, alkoxy groups such as a methoxy or ethoxy group, aryloxy groups such as a phenoxy group, amino groups such as a dimethylamino or diethylamino group, and alkylthio groups such as a methylthio or ethylthio group.

In general formula (I), $R_1$ and $R_2$ are more specifically a hydrogen atom, halogen atoms such as a chlorine or bromine atom, alkyl groups such as a methyl group, an ethyl group, a linear or branched propyl group, a butyl group or a pentyl group, aralkyl groups such as a benzyl or phenethyl group, and aryl groups such as a phenyl, naphthyl or anthryl group. These alkyl, aralkyl and aryl groups may have substituents which may be those exemplified hereinabove as substituents for the aromatic hydrocarbon and aromatic heterocyclic groups.

The indoline compound of general formula (I) may be produced, for example, by reacting an aldehyde represented by the general formula

A-CHO (II)

wherein A is as defined with regard to general formula (I), with an aminoindoline derivative represented by the general formula (III)

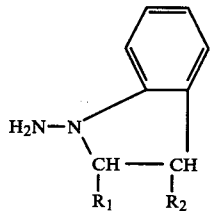

wherein $R_1$ and $R_2$ are as defined with regard to general formula (I), in ethyl alcohol under reflux at the boiling point of the reaction mixture.

Specific examples of the indoline compound corresponding to general formula (I) are given below.

1

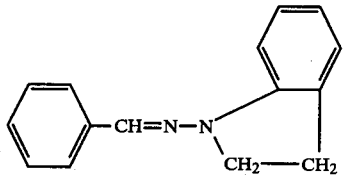

-continued
2
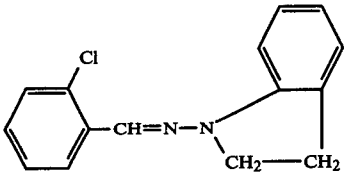
3
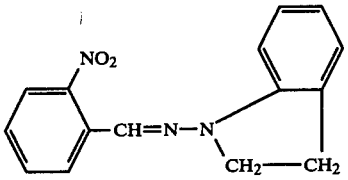
4
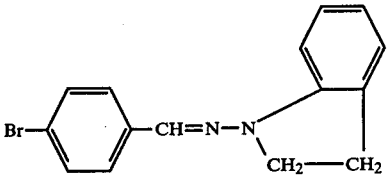
5
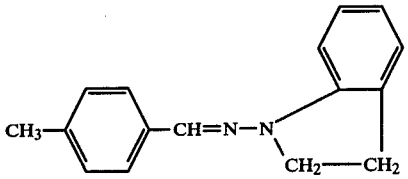
6
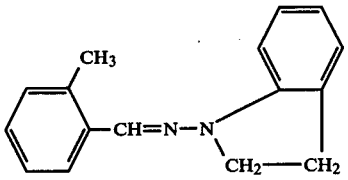
7
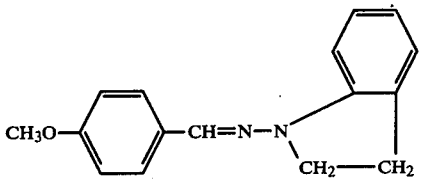
8
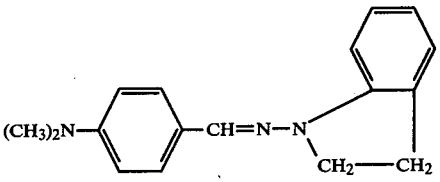
9
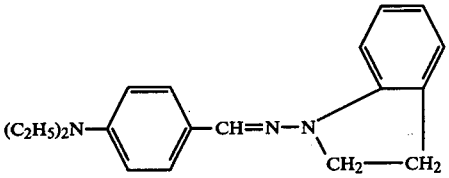
-continued
10
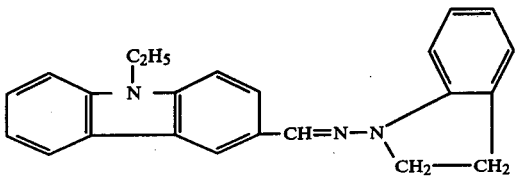
11
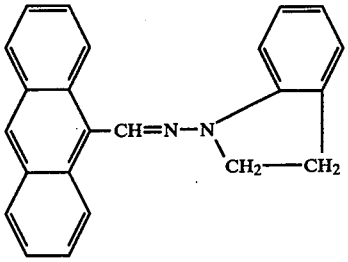
12
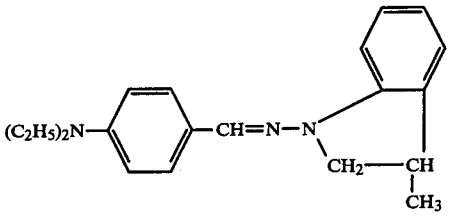
13
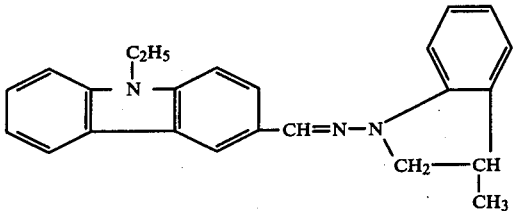
14
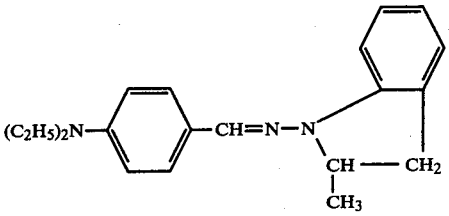
15
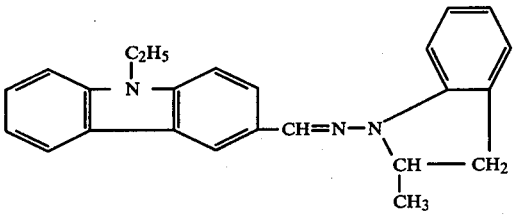
The identifying data of typical indoline compounds among these compounds Nos. 1 to 15 are summarized in the following table.
| Compound No. | Melting point | Mass analysis m/e | Elemental analysis (%) Calculated | | Found | |
|---|---|---|---|---|---|---|
| 1 | 138° C. | 222 | C | 81.04 | C | 81.11 |
| | | | H | 6.36 | H | 6.30 |

-continued

| Compound No. | Melting point | Mass analysis m/e | Elemental analysis (%) Calculated | | Found | |
|---|---|---|---|---|---|---|
| | | | N | 12.60 | N | 12.64 |
| 2 | 122° C. | 256 | C | 70.17 | C | 70.21 |
| | | 258 | H | 5.11 | H | 5.12 |
| | | | N | 10.91 | N | 10.85 |
| 5 | 169° C. | 236 | C | 81.31 | C | 81.35 |
| | | | H | 6.84 | H | 6.81 |
| | | | N | 11.86 | N | 11.90 |
| 7 | 134° C. | 252 | C | 76.15 | C | 76.09 |
| | | | H | 6.40 | H | 6.40 |
| | | | N | 11.10 | N | 11.15 |
| 9 | 106–107° C. | 293 | C | 77.76 | C | 77.82 |
| | | | H | 7.92 | H | 7.80 |
| | | | N | 14.32 | N | 14.39 |
| 10 | 144–145° C. | 339 | C | 81.37 | C | 81.30 |
| | | | H | 6.25 | H | 6.33 |
| | | | N | 12.38 | N | 12.27 |
| 11 | 186–187° C. | 322 | C | 85.67 | C | 85.60 |
| | | | H | 5.64 | H | 5.59 |
| | | | N | 8.69 | N | 8.75 |

The electrophotoconductor of this invention has a photosensitive layer containing at least one indoline compound of general formula (I).

Various embodiments of the photosensitive layer of an electrophotoconductor are known, and the photosensitive layer of the electrophotoconductor of this invention may be any of these.

The accompanying drawings are sectional views showing the structure of the electrophotoconductor of this invention in various embodiments.

Figure 1:
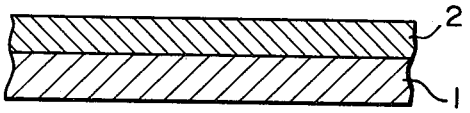
FIG. 1 shows a photoconductor composed of a conductive support (1) and formed thereon a photosensitive layer (2) consisting of the indoline compound, a binder and a sensitizing dye or an electron-attracting compound.

In the photoconductor of FIG. 1, the indoline compound in the photosensitive layer acts as a photoconductive material, and the formation and transportation of a carrier required for light decay are effected through the indoline compound. Since the absorptions of many indoline compounds exist in the ultraviolet region to the low wavelength portion of the visible region, the photosensitive layer must be sensitized in order to form an image under visible light. This can be achieved, for example, by including a sensitizing dye having an absorption in the visible region into the photosensitive layer, or adding an electron attracting compound thereto, thereby to form a charge transfer complex in the photosensitive layer. In the photoconductors shown in FIGS. 2 and 3, the carrier generating substance generates a carrier under light, and the carrier is transported by the carrier transporting medium (mainly the indoline compound in accordance with this invention acts as this medium).

Figure 2:
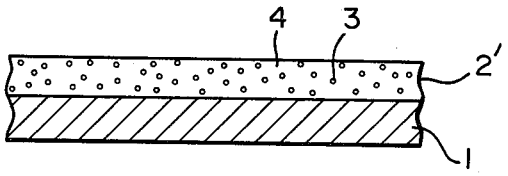
FIG. 2 shows a photoconductor composed of a conductive support (1) and formed thereon a photosensitive layer (2') obtained by dispersing a carrier generating substance (3) in a carrier transporting medium (4) consisting of the indoline compound and a binder.
Figure 3:
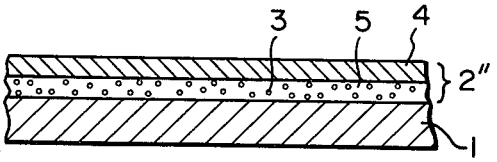
FIG. 3 shows a photoconductor composed of a conductive support (1) and a photosensitive layer (2'') consisting of a carrier generating layer (5) containing a carrier generating substance and a carrier transporting layer containing the indoline compound.

The photoconductor shown in FIG. 1 is made by dissolving the indoline compound and the binder in a solvent, optionally adding the sensitizing dye or electron attracting compound, coating the resulting solution on the conductive support, and drying it. The photoconductor shown in FIG. 2 is made by dispersing fine particles of the carrier generating substance in a solution of the indoline compound and the binder, coating the dispersion on the conductive support, and drying it. The photoconductor shown in FIG. 3 is made by vapor-depositing the carrier generating substance onto the conductive support or coating a dispersion of fine particles of the carrier generating substance and optionally a binder in a solvent on the conductive support followed by drying, thereafter coating a solution of the indoline compound and the binder on the resulting carrier generating layer, and drying it. A roll coater, a wire bar, a doctor blade, etc. are usually used for the coating operations.

The thickness of the photosensitive layer is 3 to 50 microns, preferably 5 to 20 microns, in the case of the photoconductors of FIGS. 1 and 2. In the photoconductor of FIG. 3, the thickness of the carrier generating layer is 0.5 to 5 microns, preferably 1 to 2 microns, and the thickness of the carrier transporting layer is 3 to 50 microns, preferably 5 to 20 microns. The proportion of the indoline compound in the photosensitive layer in the photoconductor of FIG. 1 is 10 to 70% by weight, preferably 30 to 50% by weight. The amount of the sensitizing dye used to impart photosensitivity to the visible region is 0.1 to 5% by weight, preferably 0.5 to 3% by weight, based on the photosensitive layer. The amount of the electron attracting compound added is 0.1 to 50% by weight, preferably 5 to 30% by weight, based on the photosensitive layer. In the photoconductor of FIG. 2, the proportion of the indoline compound in the photosensitive layer is 10 to 90% by weight, preferably 10 to 60% by weight, and the proportion of the carrier generating substance is 1 to 50% by weight, preferably 3 to 20% by weight. The proportion of the indoline compound in the carrier transporting layer in the photoconductor of FIG. 3 is 10 to 95% by weight, preferably 10 to 60% by weight. In the production of the photoconductors of FIGS. 1 to 3, a plasticizer or sensitizer may be used together with the binder.

In the photoconductor of this invention, the electrically conductive support may be a plate or foil of a metal such as aluminum, a plastic film having a metal such as aluminum vapor-deposited thereon, or paper subjected to a conductivity imparting treatment. Examples of the binder include vinyl polymers such as polystyrene, polyacrylamide or poly-N-vinylcarbazole and condensed resins such as polyamide resins, polyester resins, epoxy resins, phenoxy resins and polycarbonate resins. These examples are not limitative, and all resins which are electrically insulating and have adhesion to the support can be used.

The sensitizing dye, electron attracting compound and carrier generating substances may be those which are well known in the art.

Examples of the sensitizing dyes include triphenylmethane dyes such as methyl violet, brilliant green and crystal violet; thiazine dyes such as methylene blue; cyanine dyes; and pyrylium dyes.

Examples of the electron attracting compound include quinones such as chloranil, 1-nitroanthraquinone and 2-chloroanthraquinone; aldehydes such as 2-chlorobenzaldehyde and 4-nitrobenzaldehyde; ketones such as 3,5-dinitrobenzophenone, 2,4,7-trinitrofluorenone and 2,4,5,7-tetranitrofluorenone; acid anhydrides such as phthalic anhydride; and cyano compounds.

Examples of the carrier generating substance include inorganic photoconductive substances such as selenium, a selenium-tellurium alloy, a selenium-arsenic alloy and cadmium sulfide, and organic photoconductive substances such as copper phthalocyanine, azo pigments, disazo pigments, trisazo pigments, cyanine pigments, anthraquinone pigments, perylene pigments, pyrylium salts, thioindigo and quinacridone pigments.

The photosensitive layer may include known plasticizers in order to improve film-formability, flexibility, mechanical strength, etc. Examples of the plasticizers are phthalic acid esters, phosphoric acid esters, halogenated paraffins, and aromatic compounds such as methylnaphthalene.

As required, an adhesive layer or a carrier layer may be provided between the conductive support and the photosensitive layer in the photoconductor of this invention. Polyamides, nitrocellulose, aluminum oxide, etc. are used as materials for such an optional layer. Desirably, the thickness of this optional layer is not more than 1 micron.

The photoconductor of this invention has various advantages. For example, it has very high sensitivity, excellent durability and good flexibility. Moreover, upon repeated use, accumulation of a residual potential or variations in surface potential and sensitivity are only to a very small extent.

The following Examples illustrate the present invention more specifically. All parts in these examples are by weight.

EXAMPLE 1

| | |
|---|---|
| 2,6-(Diphenyl)-4-(4-dimethylaminophenyl)-pyrylium fluoroborate | 2 parts |
| Phenoxy resin (PKHH, a tradename of a product of Union Carbide Corporation) | 1 part |
| Dioxane | 97 parts |

The above ingredients were pulverized and mixed in a ball mill to form a dispersion of the carrier generating substance. The dispersion was coated by a wire bar on a polyester film having aluminum vapor-deposited thereon, and dried to form a carrier generating layer having a thickness of 1 micron. Then, a coating solution of 10 parts of the indoline compound No. 7 and 10 parts of a polycarbonate resin (Panlite L, a trademark for a product of Teijin Limited) in 80 parts of tetrahydrofuran was coated on the carrier generating layer to a thickness of 15 microns upon drying, thereby forming a carrier transporting layer. The product was designated as a photoconductor No. 1.

The photoconductor No. 1 was charged by corona discharge at −6 KV in a dark place by means of an electrophotographic paper testing device (SP 428, manufactured by Kawaguchi Denki Seisakusho), and then exposed to white glow light. The time (seconds) which elapsed until the surface potential was reduced to one half of the initial surface potential was measured. On the basis of the measured value, the photosensitivity, $E_{\frac{1}{2}}$, of the photoconductor was determined and found to be 4 lux sec.

EXAMPLE 2

Chlorodiane blue 2 parts

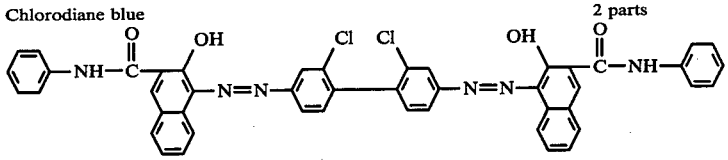

Phenoxy resin (PKHH)
Dioxane 97 parts

The above ingredients were pulverized and mixed in a ball mill to form a dispersion of the carrier generating substance. The dispersion was coated by means of a wire bar on a polyester film having aluminum vapor-deposited thereon, and dried to form a carrier generating layer having a thickness of 1 micron. On the resulting carrier generating layer was coated a solution of 10 parts of the indoline compound No. 10 and 10 parts of a polycarbonate resin (Panlite L) in 80 parts of tetrahydrofuran to a thickness of 15 microns upon drying, thereby forming a carrier transporting layer. Thus, a photoconductor No. 2 was formed.

The durability of the photoconductor No. 2 was tested by using an electrophotographic paper testing device. Specifically, a cycle consisting of applying a corona discharge of −6.0 KV to the photoconductor for 3 seconds and exposing it to white glow light having an illumination of 100 luxes while the photoconductor was rotated at about 1000 rpm on a turntable by a dynamic method was repeated 1000 times. Then, the sensitivity of the photoconductor was measured by a static method. Its sensitivity ($E_{\frac{1}{2}}$) before the repeated test was 3.0 lux sec. with a corona discharge of −6 KV and exposure to white glow light having an illumination of 5 luxes, and after exposure for 50 lux seconds, the surface potential (residual potential) was −10 V. In contrast, after charge exposure through 1000 cycles as mentioned above, the sensitivity ($E_{\frac{1}{2}}$) was 3.5 lux sec. and the residual potential was −5 V. It is therefore seen that variations in sensitivity and surface potential in this photoconductor are very little.

The photoconductor was set in an electrophotographic copier (BD-602, a tradename for a product of Toshiba Co., Ltd.) and an original document was copied. Clear copied images without fogging were obtained.

EXAMPLES 3 AND 4

Photoconductors Nos. 3 and 4 were made as in Example 2 except that the indoline compounds Nos. 9 and 11 were used respectively instead of the indoline compound used in Example 2. The sensitivities ($E_{\frac{1}{2}}$) of these photoconductors were measured. It was found that the photoconductor No. 3 had a sensitivity of 2 lux sec. and the photoconductor No. 4 had a sensitivity of 4 lux sec.

EXAMPLE 5

| | |
|---|---|
| Sensitizing dye (NOVOPERM RED BL, a tradename for a product of Hoechst AG) | 3 parts |
| Phenoxy resin (PKHH) | 1 part |
| Dioxane | 96 parts |

The above ingredients were pulverized and mixed in a ball mill to form a dispersion of the carrier generating substance. The dispersion was coated by a wire bar on a polyester film having aluminum vapor-deposited thereon, and then dried to form a carrier generating layer having a thickness of 1 micron. On the carrier generating layer was coated a solution of 10 parts of the indoline compound No. 11 and 10 parts of a polycarbonate resin (Panlite L) in 80 parts of tetrahydrofuran to a thickness of 15 microns upon drying to form a carrier transporting layer. Thus, a photoconductor No. 5 was produced. The sensitivity ($E_{\frac{1}{2}}$) of the photoconductor No. 5 measured in the same way as in Example 1 was 6 lux sec.

EXAMPLE 6

Three parts of beta-type copper phthalocyanine and 100 parts of polycarbonate (Panlite L) were added to 900 parts of dioxane and dispersed in a ball mill. Sixty parts of the indoline compound No. 10 was added to the dispersion. The resulting coating dispersion was coated by means of a wire bar on a polyester film having aluminum vapor-deposited thereon to a thickness of 15 microns upon drying to form a photosensitive layer. Thus, a photoconductor No. 6 was produced.

The photoconductor No. 6 was charged with a corona discharge of +6 KV in a dark place, and exposed to white glow light having an illumination of 5 luxes. The sensitivity ($E_{\frac{1}{2}}$) of the exposed photoconductor was 4 lux sec.

EXAMPLE 7

A solution of 20 parts of the indoline compound No. 10, 30 parts of polycarbonate (Panlite L) and 2 parts of chloranilic acid in 500 parts of dioxane was coated by a wire bar on a polyester film having aluminum vapor-deposited thereon to a thickness of 15 microns upon drying to form a photosensitive layer. Thus, a photoconductor No. 7 was produced. The sensitivity ($E_{\frac{1}{2}}$) of the photoconductor No. 7 was measured in the same way as in Example 6 was 100 lux sec.

What is claimed is:

1. An electrophotoconductor comprising a photosensitive layer containing an indoline compound of the general formula

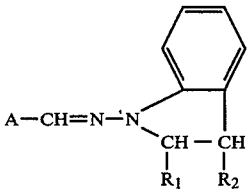

wherein A is an aromatic hydrocarbon or aromatic heterocyclic group which may have a substituent, and $R_1$ and $R_2$, independently from each other, are a hydrogen or halogen atom, or an alkyl, aralkyl or aryl group.

2. The electrophotoconductor of claim 1 wherein the indoline compound is a compound of the formula:

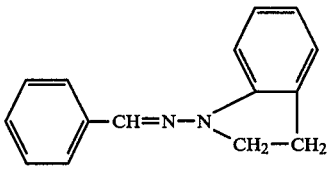

3. The electrophotoconductor of claim 1 wherein the indoline compound is a compound of the formula:

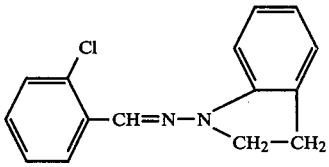

4. The electrophotoconductor of claim 1 wherein the indoline compound is a compound of the formula:

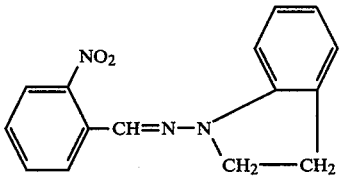

5. The electrophotoconductor of claim 1 wherein the indoline compound is a compound of the formula:

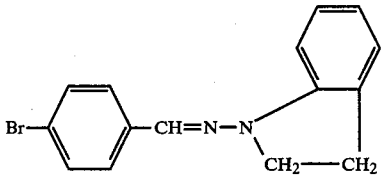

6. The electrophotoconductor of claim 1 wherein the indoline compound is a compound of the formula:

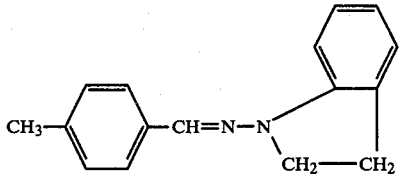

7. The electrophotoconductor of claim 1 wherein the indoline compound is a compound of the formula:

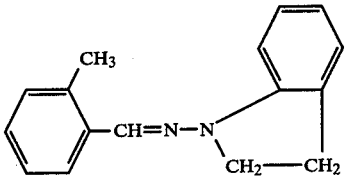

8. The electrophotoconductor of claim 1 wherein the indoline compound is a compound of the formula:

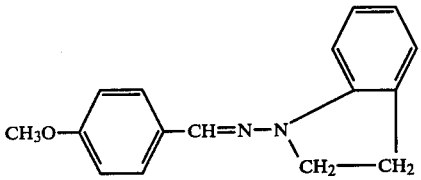

9. The electrophotoconductor of claim 1 wherein the indoline compound is a compound of the formula:

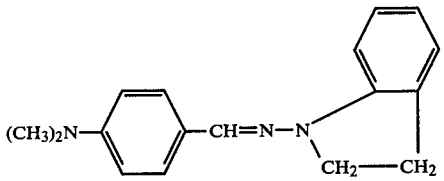

10. The electrophotoconductor of claim 1 wherein the indoline compound is a compound of the formula:

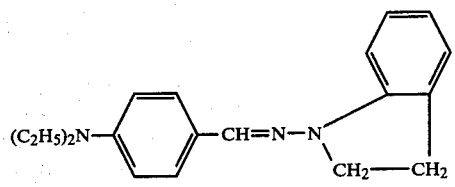

11. The electrophotoconductor of claim 1 wherein the indoline compound is a compound of the formula:

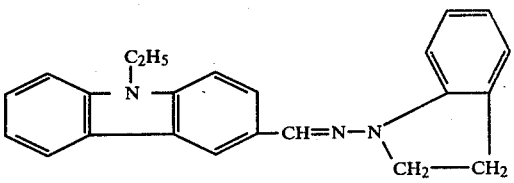

12. The electrophotoconductor of claim 1 wherein the indoline compound is a compound of the formula:

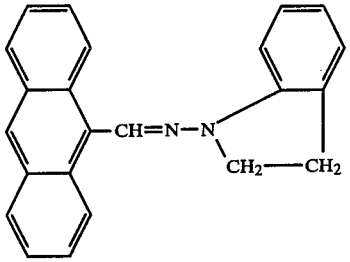

13. The electrophotoconductor of claim 1 wherein the indoline compound is a compound of the formula:

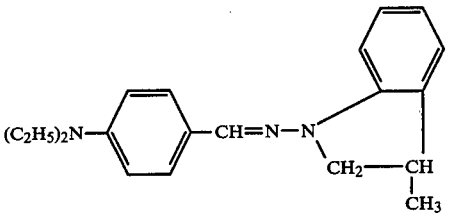

14. The electrophotoconductor of claim 1 wherein the indoline compound is a compound of the formula

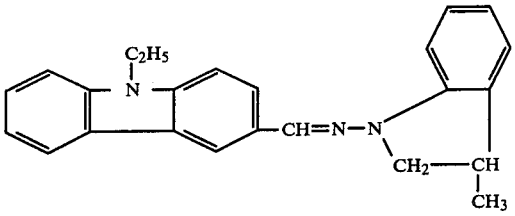

15. The electrophotoconductor of claim 1 wherein the indoline compound is a compound of the formula:

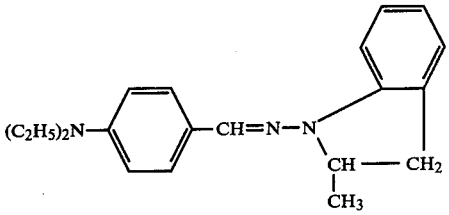

16. The electrophotoconductor of claim 1 wherein the indoline compound is a compound of the formula:

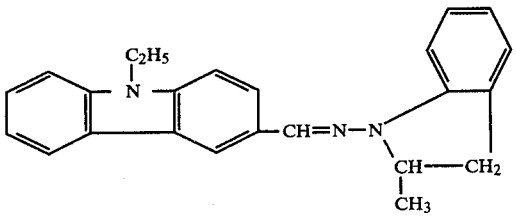

* * * * *